US008608526B2

(12) United States Patent
Ochi

(10) Patent No.: US 8,608,526 B2
(45) Date of Patent: Dec. 17, 2013

(54) AMUSEMENT APPARATUS

(75) Inventor: Yasushi Ochi, Kaizuka (JP)

(73) Assignee: BLD Oriental Co., Ltd., Izumisano Osaka Prefecture (JP)

( * ) Notice: Subject to any disclaimer, the term of this patent is extended or adjusted under 35 U.S.C. 154(b) by 0 days.

(21) Appl. No.: 13/497,095

(22) PCT Filed: Apr. 21, 2010

(86) PCT No.: PCT/JP2010/002876
§ 371 (c)(1),
(2), (4) Date: Mar. 20, 2012

(87) PCT Pub. No.: WO2011/058671
PCT Pub. Date: May 19, 2011

(65) Prior Publication Data

US 2012/0214382 A1 Aug. 23, 2012

(30) Foreign Application Priority Data

Nov. 13, 2009 (JP) ..... 2009-259838

(51) Int. Cl.
*A63H 23/00* (2006.01)
*A63H 33/22* (2006.01)

(52) U.S. Cl.
USPC ..... 446/153; 4/546; 4/584; 446/219

(58) Field of Classification Search
USPC ..... 446/153, 219; 4/488, 496, 538, 546, 4/584, 586; 472/128
See application file for complete search history.

(56) References Cited

U.S. PATENT DOCUMENTS

| | | | |
|---|---|---|---|
| 4,805,898 | A | 2/1989 | Jacober |
| 5,407,393 | A | 4/1995 | Schmidt |
| 6,582,315 | B1 | 6/2003 | Formanski |
| 2009/0012122 | A1 | 1/2009 | Branch et al. |
| 2010/0048310 | A1 | 2/2010 | Ochi |

FOREIGN PATENT DOCUMENTS

| | | | |
|---|---|---|---|
| EP | 2058030 | A1 | 5/2009 |
| JP | 111677/1977 | U | 3/1979 |
| JP | 139254/1978 | U | 4/1980 |
| JP | 125903/1982 | U | 4/1984 |
| JP | 62-129072 | A | 6/1987 |
| JP | 73404/1989 | U | 2/1991 |

(Continued)

OTHER PUBLICATIONS

International Search Report; Application No. PCT/JP2010/002876; Jul. 6, 2010; Japanese Patent Office.

(Continued)

*Primary Examiner* — John Ricci
(74) *Attorney, Agent, or Firm* — Stevens & Showalter LLP

(57) ABSTRACT

An amusement apparatus 100 of the present invention comprises a mirror placed in the bath, a support 125, a lighting member 129, a half mirror 128, a transparent waterproof sheet 130, a waterproofing mechanism 145, and an inlet 146. The support 125 and the lighting member 129 is placed on the mirror 120, the half mirror 128 is supported to the support 125, placed to an inner wall of bath 110 watertightly. Transparent waterproof sheet 130 coats the aperture upper part of bath 110, by a waterproofing mechanism the transparent waterproof sheet is watertightly fixed in the bath. Also an inlet for injecting a liquid between the half mirror and transparent waterproof sheet is provided, by the lighting member lighting up a region between the half mirror and the mirror, a reflection of the light is repeated in the region.

7 Claims, 6 Drawing Sheets

(56) References Cited

FOREIGN PATENT DOCUMENTS

| | | | |
|---|---|---|---|
| JP | 4-15989 | U | 2/1992 |
| JP | H07-098782 | A | 4/1995 |
| JP | 7-265548 | A | 10/1995 |
| JP | 8-38649 | A | 2/1996 |
| JP | 8-211330 | A | 8/1996 |
| JP | H08-196747 | A | 8/1996 |
| JP | 8-229244 | A | 9/1996 |
| JP | 9-108449 | A | 4/1997 |
| JP | H11-299635 | A | 11/1999 |
| JP | 2000116959 | | 4/2000 |
| JP | 2000167254 | | 6/2000 |
| JP | 2000197715 | A | 7/2000 |
| JP | 2001169864 | A | 6/2001 |
| JP | 2004208844 | A | 7/2004 |
| JP | 2005-52305 | A | 3/2005 |
| JP | 2005131215 | A | 5/2005 |
| JP | 2008067741 | A | 3/2008 |
| JP | 2008073497 | A | 4/2008 |
| JP | 2008536082 | A | 9/2008 |
| JP | 2008231904 | A | 10/2008 |
| JP | 2009-11421 | A | 1/2009 |
| WO | 2006025108 | A1 | 3/2006 |

OTHER PUBLICATIONS

Tuneaki Oota; Written Opinion of the International Searching Authority; Application No. PCT/JP2010/002876; Jul. 6, 2010; Japanese Patent Office.

Ochi, Yasushi; U.S. Appl. No. 13/497,070; Apr. 21, 2010 I.A. Date; entitled Tree-Shaped Decoration Apparatus.

Ochi, Yasushi; U.S. Appl. No. 13/497,081; Apr. 21, 2010 I.A. Date; entitled Rotating Amusement Apparatus.

Ochi, Yasushi; U.S. Appl. No. 13/497,085; Apr. 21, 2010 I.A. Date; entitled Slide Device.

Ochi, Yasushi; U.S. Appl. No. 13/497,102; Apr. 21, 2010 I.A. Date; entitled Amusement Apparatus.

Ochi, Yasushi; U.S. Appl. No. 13/497,116; Apr. 21, 2010 I.A. Date; entitled Rocking Play Device.

International Search Report; Application No. PCT/JP2010/002872; Jun. 1, 2010; Japanese Patent Office.

Makoto Suzuki; Written Opinion of the International Searching Authority; Application No. PCT/JP2010/002872; Jun. 1, 2010; Japanese Patent Office.

International Search Report; Application No. PCT/JP2010/002873; Jun. 8, 2010; Japanese Patent Office.

Tamotu Sakai; Written Opinion of the International Searching Authority; Application No. PCT/JP2010/002873; Jun. 8, 2010; Japanese Patent Office.

International Search Report; Application No. PCT/JP2010/002875; Jun. 1, 2010; Japanese Patent Office.

International Search Report; Application No. PCT/JP2010/002877; Jun. 22, 2010; Japanese Patent Office.

Naoki Turuoka; Written Opinion of the International Searching Authority; Application No. PCT/JP2010/002877; Jun. 22, 2010; Japanese Patent Office.

International Search Report; Application No. PCT/JP2010/002878; May 25, 2010; Japanese Patent Office.

Yosiaki Usui; Written Opinion of the International Searching Authority; Application No. PCT/JP2010/002878; May 25, 2010; Japanese Patent Office.

(A)

(B)

(A)

(B)

AMUSEMENT APPARATUS

TECHNICAL FIELD

This invention relates to an amusement apparatus and, in particular, the invention relates to an amusement apparatus enabling simulated water play experiences for an infant or the like.

BACKGROUND ART

For example, as a playground equipment for infants who can do swimming pool play, a small facility model swimming pool is disclosed in the following patent document. Currently, such amusement apparatus which can play with water include the example disclosed in Japanese Unexamined Pat. App. Pub. No. 2000-197715. The amusement apparatus in this instance is provided with a small simple model swimming pool.

SUMMARY OF THE INVENTION

Problem Invention is to Solve

A pool for infants described in the prior art stores water in a pool. When a user (assume infant or the like, the same shall apply hereinafter) begins a game in a pool, raises a spray of water, and thus the floor gets wet when it is installed in a supermarket or a department store. Because when the floor gets wet, it is slippery, and thus many amusement apparatus installers hesitated about the setting of the device. On the other hand, instead of merely really doing a play in the water, if an infant experiences simulated water play, the infants often continue their interest. Also the possibility that infants are drowned is not zero when doing play-in-water, and thus the protectors of such infants have to always watch infants when doing play-in-water. An object of the present invention, brought about in view of the circumstance described above, is to make available an amusement apparatus, for entertaining an infant easily and for enabling simulated water play experiences, with excellent ability of maintenance such as repair and change.

Means for Resolving the Problem

An amusement apparatus 100 of the present invention comprises a mirror placed in the bath, a support, a lighting member, a half mirror, a transparent waterproof sheet, a waterproofing mechanism, and an inlet. The support and the lighting member are placed on the mirror, the half mirror is supported by the support and placed to an inner wall of the bath watertightly. The transparent waterproof sheet coats the aperture upper part of the bath. By a waterproofing mechanism the transparent waterproof sheet is watertightly fixed in the bath.

Also an inlet for injecting a liquid between the half mirror and transparent waterproof sheet is provided. By the lighting member lighting up a region between the half mirror and the mirror, a reflection of the light is repeated in the region. In the present invention, the inlet for injecting a liquid is provided on the half mirror upper part, and the present invention can watertightly fix the transparent waterproof sheet and the bath by the waterproofing mechanism. Therefore, for example, by making a game on a transparent waterproof sheet, a user, such as an infant, is able to simulate water play experiences.

Also when a different region of the light intensity is partitioned off in the half mirror, from high light intensity (bright) to low light intensity (dark), a half mirror functions as a mirror. Therefore, by lighting up the space formed by the mirror and the one-way mirror, faces of bath 110 lighted by the bath lighting member function as a mirror. The reflection of the light can repeat between the half mirror and the mirror. Thereby, it makes the feeling that a bottom of the bath is deeper than it is in reality to a user making a game on the transparent waterproof sheet. And it is able to perform simulated water play experiences to a user.

In accordance with an aspect of the present invention, it is desirable that an auxiliary bath surrounds the bath, and that a swing member is provided in the lower part of the auxiliary bath, for swinging the amusement apparatus. Also a regulation means for regulating a swing range of the swing member may be provided. By an auxiliary bath surrounding the bath, even if liquid leaks out from the transparent waterproof sheet, the leaked liquid is collected in the auxiliary bath, thus it does not get the floor wet. Therefore, it decreases the risk of a slippery wet floor.

In accordance with an aspect of the present invention, it is desirable that a dome-shaped roof is provided on an upper part of the bath with an opening for a child to enter. By forming an opening for a child to enter, the amusement apparatus of this invention can prevent an adult from getting on the transparent waterproof sheet thereof. Therefore, it prevents an excessive load from being applied to the transparent waterproof sheet, and thus users such as the infant can play with the amusement apparatus safely.

In accordance with an aspect of the present invention, it is desirable that a plurality of the supports are placed relative to each other at a required interval, and that small play equipment is placed between the plurality of the supports. For example, by placing the small play equipment, reminders of the deep-sea, between the supports, the decorative effect of the small playground equipment can bring a deep-sea feeling.

Also a shock absorber can coat a part of the amusement apparatus. As the shock absorber, urethane can be used. By coating the amusement apparatus with a shock absorber such as urethane, even if a user bumps or drops the amusement apparatus by mistake, the shock absorber absorbs the shock, so that a user has no risk to injury.

Effects of the Invention

In the present invention, an inlet for injecting a liquid is provided on the half mirror upper part, and the present invention can watertightly fix the transparent waterproof sheet to the bath by a waterproofing mechanism. Therefore, for example, by making a game on the transparent waterproof sheet, a user such as infants is able to simulate water play experiences. Also the reflection of the light can repeat between the half mirror and the mirror. And thus, it makes the feeling that a bottom of the bath is deeper than it really is to a user making a game on the transparent waterproof sheet.

In addition, the transparent waterproof sheet and bath are fixed by a waterproofing mechanism watertightly. And thus a playground equipment with excellent ability of maintenance such as repair and change can be provided.

DESCRIPTION OF THE PREFERRED EMBODIMENT

Figure 1:
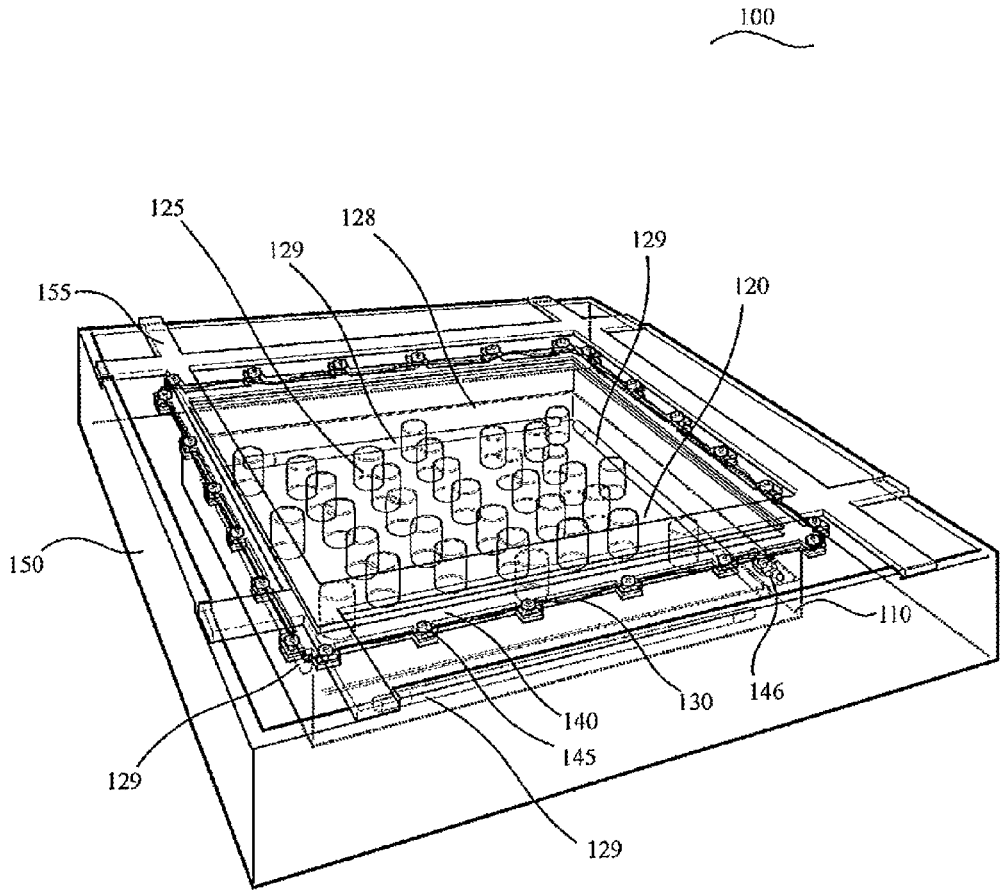
FIG. 1 is a perspective view illustrating an outlined configuration of an amusement apparatus in accordance with an embodiment of the present invention.
Figure 2:
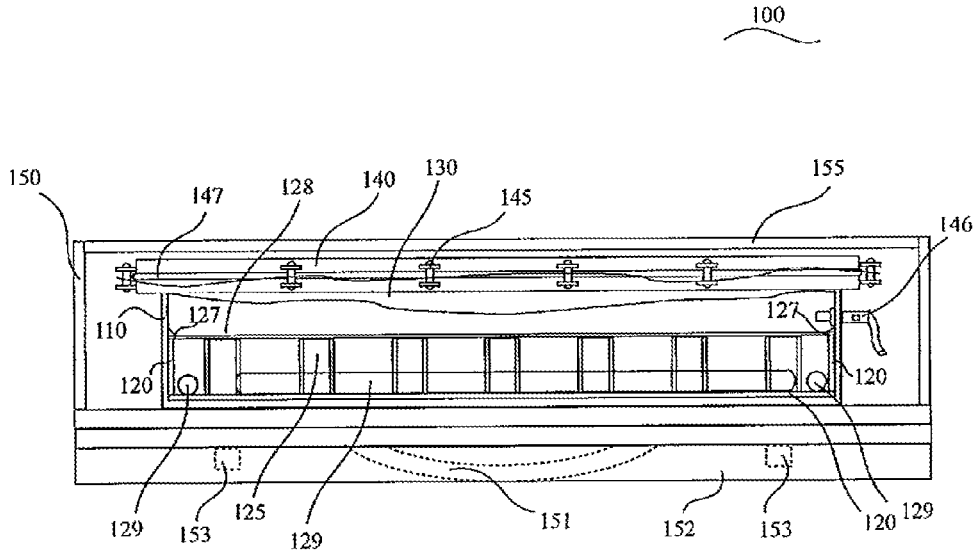
FIG. 2 is a side view of an amusement apparatus in accordance with an embodiment of the present invention.
Figure 3:
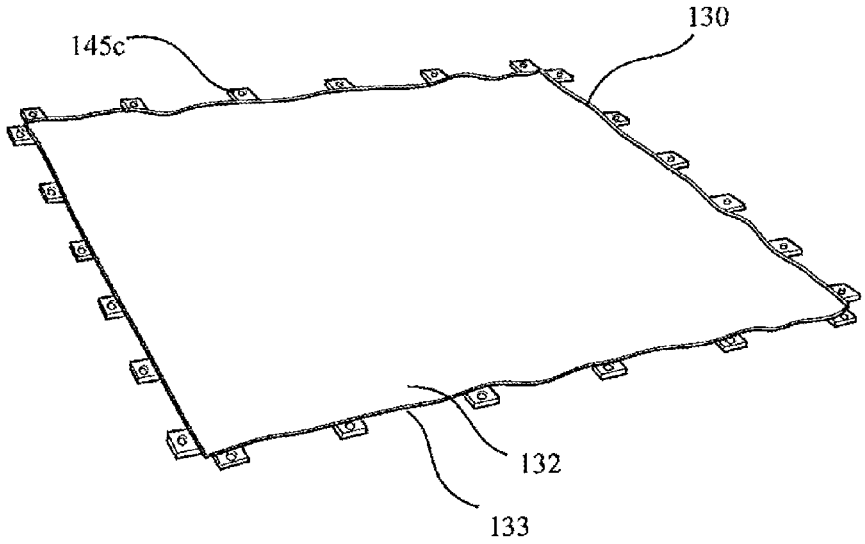
FIG. 3 is a perspective view illustrating of a transparence waterproof sheet used for an amusement apparatus in accordance with an embodiment of the present invention.
Figure 4:
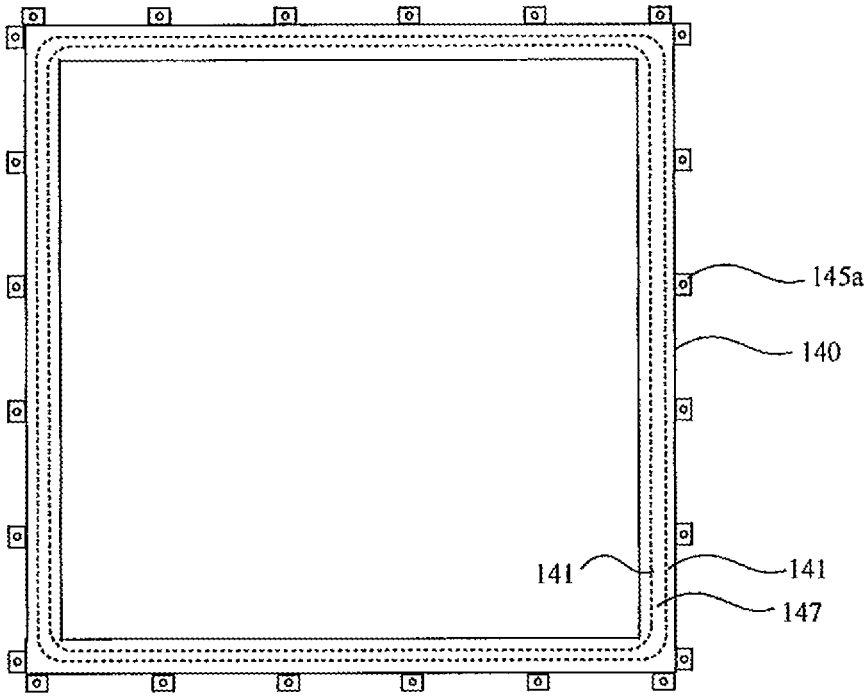
FIG. 4 is a top view illustrating of a rectangular frame and a bath used for an amusement apparatus in accordance with an embodiment of the present invention.
Figure 4:
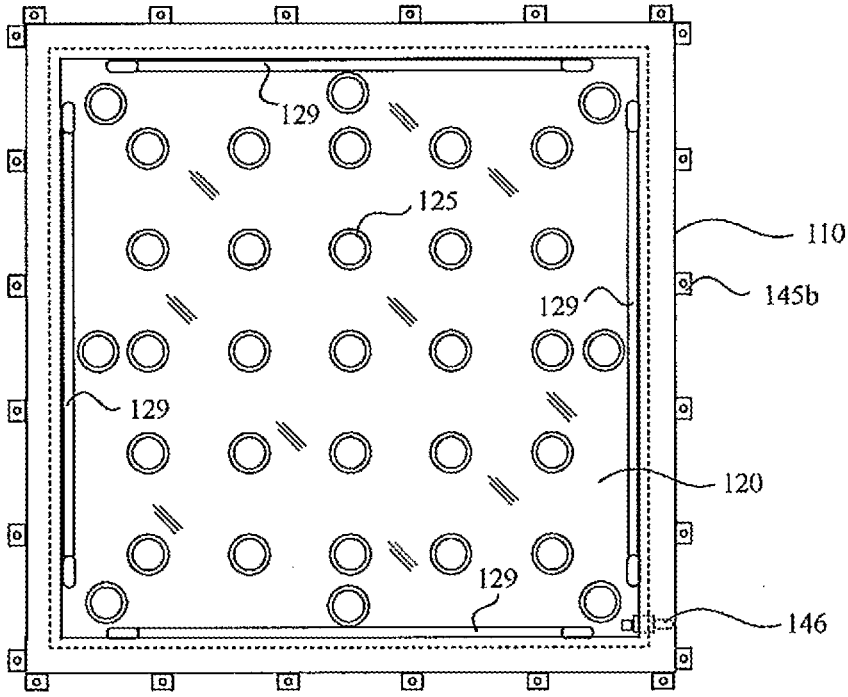

A specified embodiment of an amusement apparatus 100 is explained hereinafter with reference to the accompanying drawings. FIG. 1 is an outline schematic view of an amusement apparatus 100 of the present invention, FIG. 2 is a side view, FIG. 3 is an outline schematic view of after-mentioned transparent waterproof sheet 130, and FIG. 4 shows a top plan view of after-mentioned frame 140 and bath 110. However, the details of the all parts which do not directly-relate to the present invention will be omitted.

As shown in FIG. 1, an amusement apparatus 100 of the present invention is provided with a rectangular bath 110 upwardly opened, with a flexible sheet covering a liquid surface such as water filled in the bath 110, with a waterproof mechanism 145 for preventing the liquid from leaking out from the sheet 130, and with a mechanism (described below) directing depth in the bath. A mirror 120 is attached on an inner bottom surface of the bath 110 and on four side faces (to a height as specified below) thereof. As will hereinafter be described, water is filled in the bath 110. Because it is assumed that infants make a game, a load, such as a load of water and the infants is placed on the mirror 120. Therefore, it is desirable that the mirror 120 be hard to break. In the present embodiment, an acrylic mirror having a mirror on one side surface of an acrylic part is placed on the bottom surface and on the four side faces.

Hence, a film-formed mirror may be attached on the bottom surface and on the four side faces.

Then, a plurality of cylinders 125 are formed by a translucent member. And, the transparent cylinders 125 are placed on the bottom surface of the bath 110 (mean the inside thereof) attached to the mirror 120 as discussed above. The cylinders 125 are placed as symmetrically as possible, so as to support dispersedly the load acting on the undersurface of bath 110. In the present embodiment, the transparent cylinders 125 are placed, so that one transparent cylinder 125 is placed on each of four corners of the bottom surface of the bath 110, four in all, and that transparent cylinders 125 are placed on the center of the bottom surface arranged in an array of rows and columns (in the present example, an array of 5*5). Transparent cylinders 125 function as a support for supporting an after-mentioned one-way mirror.

After placing the transparent cylinders 125 in the bath as discussed above, a half mirror (in the present example, so-called one-way mirror 128 of 50% of transmittancy) having a specified transmittancy and reflectance is placed on the upper part of the transparence cylinders 125. At this time, the one-way mirror 128 is placed so as to face the mirror 120 put on the bottom surface of the bath 110 (so that one-way mirror 128 is parallel to the mirror 120). In the present embodiment, the one-way mirror 128 has affixed reflectance, the mirror of 50% of transmittancy to transparent acryl resin. In the present embodiment, the mirror having a reflectance and transmittancy of 50% is attached to a transparent acryl resin, and used as the one-way mirror 128.

By placing the mirror 120 and one-way mirror 128 as described above, the reflection of the light is repeated by the mirror 120 and one-way mirror 128, and transparent cylinders 125 are reflected as a stacked state. Therefore, when viewed from the upper bath 110, it is felt that the transparent cylinders 125 are reflected as a stacked state, and thus the impression of spreading the distances (depth) between the one-way mirror 128 and mirror 120 of the bottom faces of the bath 110, can be given to the users. When a different region of light intensity is partitioned off with one-way mirror 128, from high light intensity (bright) to low light intensity (dark), one-way mirror 128 functions as a mirror. Therefore, a plurality of lighting members 129 such as LEDs are provided in the region formed by the one-way mirror 128 and the bottom surface mirror 120 of the bath 110. And, the light intensity in the bath 110 rises by lighting up the region with a lighting member, and thus, the one-way mirror 128 facing side of the mirror 120 of the bottom faces of bath 110 functions as a mirror.

As described above, in order to fill with liquids such as water, the clearance between the one-way mirror 128 and bath wall surface in the bath 110 is waterproofed so as not to leak the liquid. In the present embodiment, the liquid leak is prevented with gummy caulking 127 on the clearance. As shown in FIG. 2, the mirror 120 attached on four side faces of the bath 110 should be attached to the height of the transparent cylinders 125. As for height of the mirror 120 of the four side faces, the height of the transparent cylinders 125 is enough, because the four side faces are attached for directing as if the distance between the one-way mirror 128 and bottom faces mirror 120 of the bath 110 is spread.

Then the bath 110 configured as above is coated with a waterproof sheet (corresponding to transparent waterproof sheet 130) using the material of the translucency. And, by waterproofing mechanism 145, above sheet 130 and bath 110 are fixed watertightly. In this embodiment, as material of the translucency, polyvinyl chloride (hereinafter, PVC) is used. The polyvinyl chloride yellow-discolors if the polyvinyl chloride makes contact with moisture directly, because the plasticizer generally used for manufacture of the polyvinyl chloride exudes. And thus it is desirable that the transparent waterproof sheet 130 does not make contact with the liquid, such as the water, directly. For example, as illustrated in FIG. 3, a laminating sheet, with the sheet 132 of polyvinyl chloride stacked onto the waterproof sheet 133 (use material of the translucency), is used as the transparent waterproof sheet 130. For example, as material of the waterproof sheet, polyvinylidene chloride (hereinafter PVDC) which is a component of Saranwrap (registered trademark) is preferably used. The laminating sheet is used with the waterproof sheet 133 facing downwards (touch the water in the bath directly).

Leaking from the edges of the transparent waterproof sheet 130 can be prevented with a waterproofing mechanism 145 when a liquid is filled within bath 110. Any waterproofing mechanism 145 may be used. However, in the present embodiment, the following configuration is adopted. As for the waterproofing mechanism 145 of this invention, a frame 140 (because the bath 110 is rectangular in the present example, the shape of the frame is rectangular) of shape substantially identical to the shape of upper end of the bath 110 is formed first (cf. FIG. 3). Concave part 141 that can store tube 147 is formed in each side of the rectangular frame 140 (e.g., formed of a urethane material). Each height of the concave part 141 and tube 147 is adjusted so that a part on the tube 147 projects while tube 147 is accommodated to above concave part 141. Of course, when rectangular frame 140 is fixed to the bath 110, height of concave part 141 is adjusted so that the tube 147 is not broken. Tube 147 has a length roughly adding four sides of rectangular frame 140, and transparent waterproof sheet 130 is fixed watertightly by tube 147 adhering to the upper end of bath 110.

A plurality of fixtures 145*a* for fixing the frame 140 and bath 110 are attached to each side of rectangular frame 140, and fixtures 145*b* that are the same thereof are attached at a position corresponding to the upper end of the bath 110. And, as shown in FIG. 3, fixed portions 145*c* of a shape substantially identical to the shape of the fixtures 145*a*, 145*b* are provided to the transparent waterproof sheet 130. And thus, the fixtures 145*a*, 145*b* are fixed by a fixed member to each other, in the condition that the fixed portion 145*c* of the transparent waterproof sheet 130 is sandwiched between the fixtures 145*a*, 145*b*. Fixtures 145*a* of the frame 140, fixtures 145*b* of the bath 110, fixed portions 145*c* of the transparent waterproof sheet 130, and the fixed members are equivalent to the waterproofing mechanism 145.

Liquids such as the water are filled in the bath 110 configured as above. That is to say, liquids such as the water are poured onto one-way mirror 128 being a bottom face. Therefore, a bung hole 146 for injecting the water is provided to an opening opened in inner wall surfaces of the bath 110. The bung hole 146 is provided in a more upward position than the one-way mirror 128.

Also in this embodiment, the bath 110 is surrounded with an auxiliary bath 150 capable of containing the bath 110 so that liquid is not scattered on a floor even if a liquid in the bath 110 leaked. Undersurface (the outside) of bath 110 is fixed to the inner bottom surface of the auxiliary bath 150 by a floor covering materials (not shown). A swing member 151 for swinging the amusement apparatus 100 back and forth is fixed to the outside undersurface of the auxiliary bath 150. A swing member 151 is formed by curving a pipe at specified curvature radius. And the curved pipe as above is fixed to the outside undersurface (in the present example in the neighborhood of the center) of the auxiliary bath 150, in the condition a curvature salient of the pipe is facing downward.

If the swing member 151 is able to swing the amusement apparatus 100, any shape is preferable. For example, other than the shaped curve pipe as described above, as the swing member 151, a bowl shaped member formed in top face view circle shape having U-shaped cross-section is formed, and the bowl shaped member may be fixed to the outside undersurface of auxiliary bath 150.

By using a swing member 151 of the bowl shape, amusement apparatus 100 enabling a swinging from front to back and from side to side can be configured.

Also a regulating member regulating a swing action of swing member 151 is fixed in an edge neighborhood of the outside undersurface of the auxiliary bath 150. And a position and height of the regulating member are adjusted so that a user's foot is not caught between clearance outside undersurface of the auxiliary bath 150 and the floor line. For example, in the present embodiment, an elastic member 152 such as urethane is attached to the outside undersurface edge of auxiliary bath 150 to surround swing member 151. Furthermore, a fixed member 153 having a specified height (the high hoping to regulate the swing movement) is fixed at the position of the specified distance (in the present embodiment, around 20 centimeters) from the both ends thereof.

By providing the regulating member as above, even if the amusement apparatus 100 is swung by the swing member 151 and the gap is formed between the outside undersurface of the auxiliary bath 150 and floor, the elastic member 152 fills the gap of the both ends of the outside undersurface of the auxiliary bath 150, and thus it is prevented that a user is caught in the gap of the both ends. Furthermore, a chair part can be provided in 4 corners of upper end of the auxiliary bath 150. For example, by putting chair frame 155 on auxiliary bath 150 as shown in FIG. 1, a chair part can be configured to the upper part of the chair frame 155. By applying a load on one of the chair parts of the 4 corners, it can easily swing the amusement apparatus 100 and a swing range thereof is regulated by the regulating member. And thus safe swing mechanism enabling easily swing is configured.

A specified shock absorber is coated to the amusement apparatus 100 of the present invention. For example, a shock absorber such as urethane is formed into a sheet form. And the shock absorber is coated on a part of the amusement apparatus 100 (even all surface of the apparatus is preferable and may be the part that it is expected that a user comes in contact with the outside of the auxiliary bath 150), and, a luster material is processed on the surface of the shock absorber. The shock absorber may be composition except urethane, and shock absorber like foams such as polyethylene is preferably used.

The auxiliary bath is coated in shock absorber so that the shock absorber reduces shock and prevents an injury effectively even if a user falls from the amusement apparatus 100 by mistake. The next description is a method of use of the amusement apparatus 100 of the present invention. At first, an openings of the bath 110 is coated with the waterproofing transparence sheet 130 (when a laminating sheet is used, waterproof sheet 133 is facing downwardly). And the sheet 130 and bath 110 are fixed watertightly with the waterproofing mechanism 145.

Then the feeding mechanism (not shown) enabling feeding the outside water and other liquids (hereinafter described with water as an example) is connected to an inlet 146 provided to the bath 110, and water is injected in the bath. At this time, water is injected until a central part of the bath 110 coated with transparent waterproof sheet 130 swells (mean being convex). When viewing the bath 110 from the part that the central part of bath 110 has swelled (hereinafter called convex part), it gives a bulging appearance of bath 110. Also because light is refracted in the convex part, the inside of the bath 110 is viewed even from a little spaced-apart distance from the bath 110.

As described above, as for the bath 110 inner area (mean inside lower portion), the transparent cylinders 125 are placed between the one-way mirror 128 and the mirror 120 of the bottom surface. And thus a reflection of the light is repeated by the above configuration. When bath 110 lower portion is viewed from the convex part, in the mirror, the extended transparent cylinders 125 are reflected like a stacked cylinder. Thereby, the amusement apparatus 100 can give users such as infants a feeling that bottom of bath 110 is deep or a bottomless.

Figure 7:
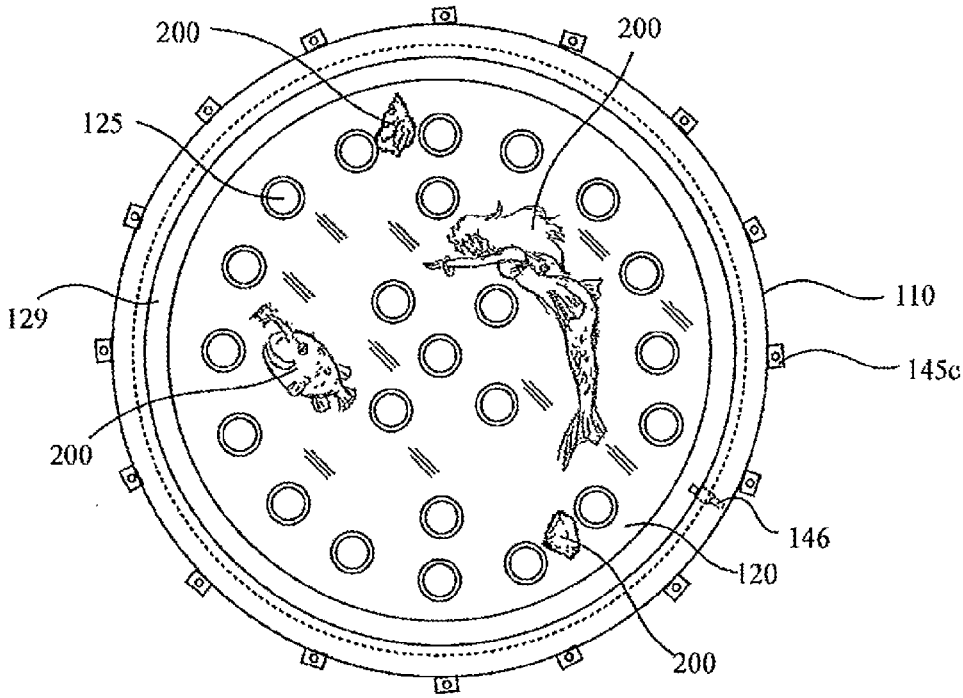
FIG. 7 is a top view illustrating a bath which placed a small playground equipment used for an amusement apparatus in accordance with the embodiment of the present invention.

Also a swing member 151 is provided to the lower part of the amusement apparatus 100 of this invention. And thus, amusement apparatus 100 swings to the right and left and back and forth (if the swing member 151 of the bowl shape is used, it swings from front to back and from side to side, in all directions). By sitting down on the guardian's chair part provided on 4 corners of auxiliary bath 150, amusement apparatus can easily swing. Furthermore, as shown in FIG. 7, a small playground equipment 200 may be placed between one-way mirror 128 and the mirror 120 of the bottom surface. However, bath 110 of FIG. 7 is formed as top view circle shape. When a small playground equipment 200 collides to transparent cylinder 125 placed between one-way mirror 128 and the mirror 120 of the bottom surface, the small playground equipment 200 equipped with a drive means such as a motor enabling a changing direction may be used. The placing of various small playground equipments 200, and decorated like the deep sea, can give a decoration effect as if the user feels being in the deep sea, by being combined with the one-way mirror 128, the reflection of the light with mirror 120 of the bottom surface, and an enlarged effect by the convex part of the bath 110. Four side faces in bath 110 and waterproofing transparence sheet 130 may be colored a blue or water injected may be colored a blue so as to give appearance of the deep-sea.

Figure 5:
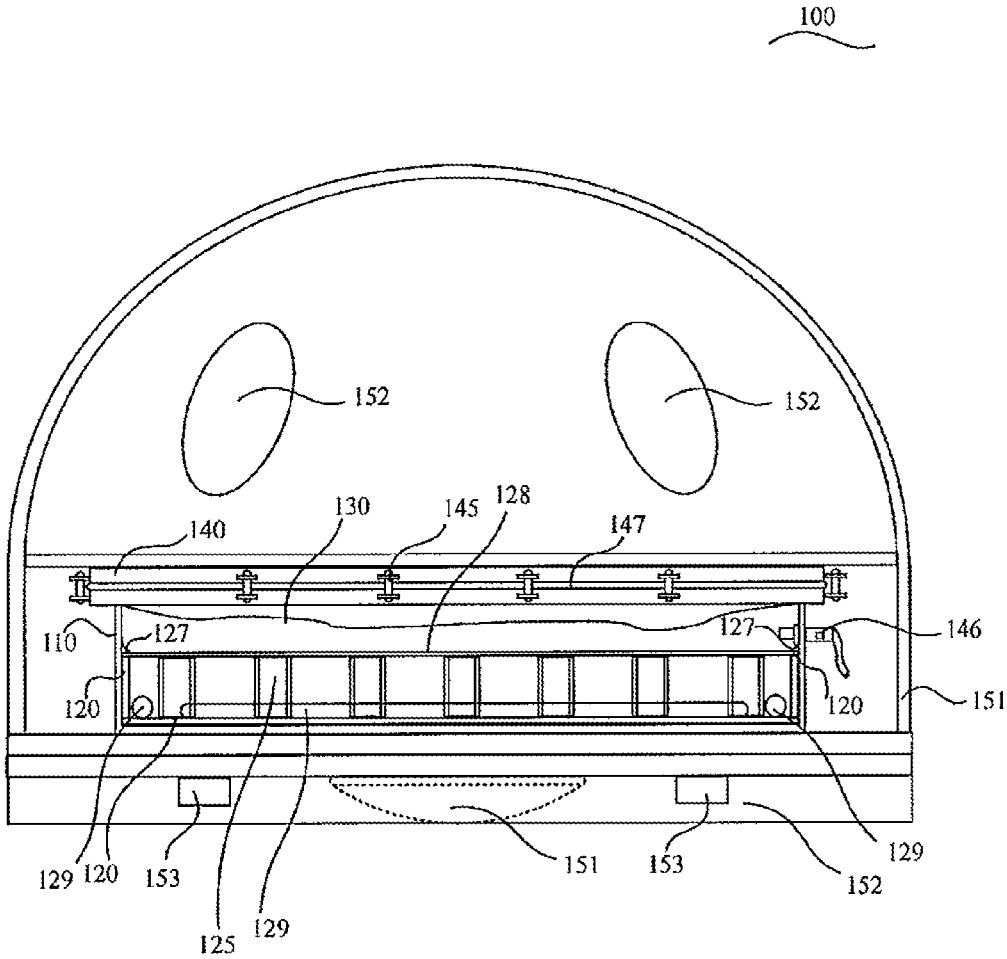
FIG. 5 is a side view of an amusement apparatus in accordance with an embodiment of the present invention.
Figure 6:
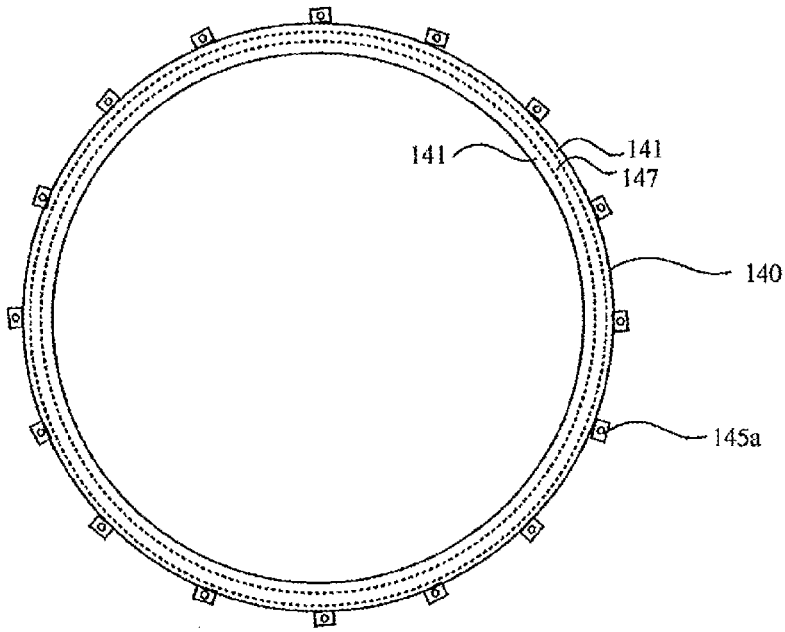
FIG. 6 is a top view illustrating of a rectangular frame and a bath used for an amusement apparatus in accordance with an embodiment of the present invention.
Figure 6:
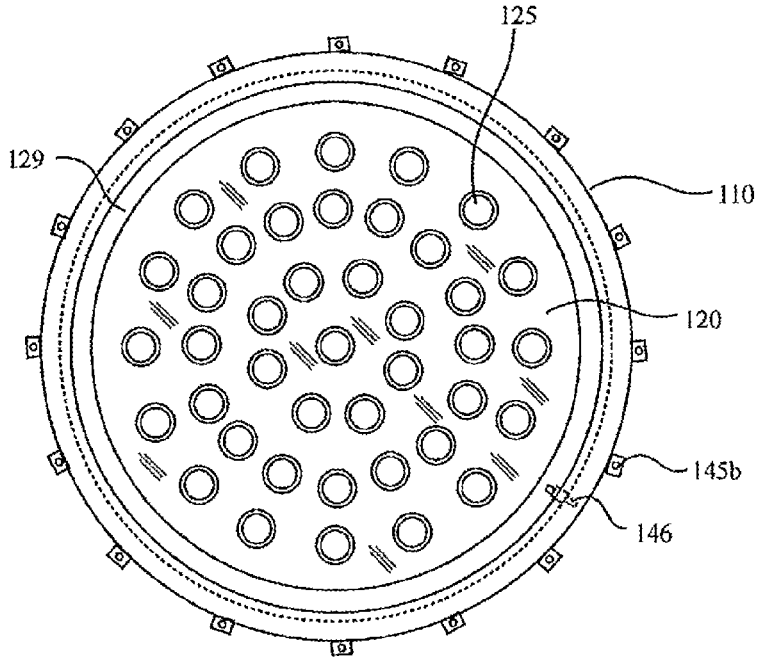

With detailed description of the preferred embodiment 1, the bath 110 and auxiliary bath 150 are formed into a rectangle shape. As shown in FIGS. 5 and 6, in detailed description of the preferred embodiment 2, it is different that the bath 110 and auxiliary bath 150 are formed into a circle shape. Also a dome-shaped roof 151 is provided to the upper part of bath 110 of the present embodiment.

An opening 152 into which a child (include infant) can crawl is formed in the dome-shaped roof 151. It is difficult for an adult to enter in the amusement apparatus 100 from this opening 152. Because it makes it difficult for an adult to play with the amusement apparatus 100 of the present invention, it can be prevented that an adult gets on the waterproofing transparence sheet 130 placed on the bath 110. Therefore the excessive load applied onto waterproofing transparence sheet 130 can be prevented beforehand, and safety is further secured. As illustrated in FIG. 6, in the present embodiment, because the bath 110 is formed into a top view circle shape, a frame 140 is formed into a circle shape.

As discussed above, the amusement apparatus 100 of the present invention is able to perform simulated water play experiences to a user. Also the amusement apparatus 100 full of changes can be provided, because a user does not get tired, by amusement apparatus 100 swinging.

The present invention is able to make simulated water play experiences to a user in a simple configuration. Also by repeating a reflection of the light, with a mirror and a half mirror, the bottom surface of the bath becomes able to be shown to a user more deeply than reality. Thus it is able to perform simulated water play experiences to a user, while making continued interest for an infant. Therefore, the industrial applicability is provided. The embodiments and implementations that have been disclosed here are illustrative by nature and should not be regarded as limiting. The scope of the invention is defined by its claims rather than the foregoing description, and should be understood to include the features of the claims of the invention and equivalents thereof, in addition to all changes falling within the scope of the claims.

What is claimed is:

1. An amusement apparatus having a bath, comprising:
- a mirror placed in the bath;
- a support and a lighting member placed on the mirror;
- a half mirror supported by the support and watertightly placed to an inner wall of the bath;
- a transparent waterproof sheet for covering an open upper part of the bath;
- a waterproofing mechanism for watertightly fixing the transparent waterproof sheet to the bath;
- an inlet for injecting a liquid between the half mirror and transparent waterproof sheet;
- the lighting member lighting up a region between the half mirror and the mirror so that a reflection of the light is repeated in the region.

2. The amusement apparatus according to claim 1, further comprising
- an auxiliary bath surrounding the bath; and
- a swing member provided in the lower part of the auxiliary bath.

3. The amusement apparatus according to claim 2, further comprising a regulation means regulating a swing range of the swing member.

4. The amusement apparatus according to claim 1, further comprising a dome-shaped roof provided on an upper part of the bath having an opening for a child to enter.

5. The amusement apparatus according to claim 1, wherein the support comprises a plurality of cylinders placed next to each other at a required interval, and further comprising small play equipment placed between the plurality of the cylinders.

6. The amusement apparatus according to claim 1, further comprising a shock absorber for coating a part of the amusement apparatus.

7. The amusement apparatus according to claim 6, wherein the shock absorber is urethane.

* * * * *